US011423726B2

(12) United States Patent
Cowles et al.

(10) Patent No.: US 11,423,726 B2
(45) Date of Patent: Aug. 23, 2022

(54) MOBILE DEVICE ACCESS BADGES

(71) Applicant: Maximus, Inc., Austin, TX (US)

(72) Inventors: David Cowles, Reston, VA (US); Dan Biernacki, Kingston, NJ (US); Abby Flock, Washington, DC (US); Fran Casale, Dowingtown, PA (US); Michael Garbus, Aldie, VA (US); Michael Weiner, Reston, VA (US); Bruce Perkins, Austin, TX (US)

(73) Assignee: Maximus, Inc., Austin, TX (US)

( * ) Notice: Subject to any disclaimer, the term of this patent is extended or adjusted under 35 U.S.C. 154(b) by 0 days.

(21) Appl. No.: 17/238,058

(22) Filed: Apr. 22, 2021

(65) Prior Publication Data

US 2021/0335074 A1 Oct. 28, 2021

Related U.S. Application Data

(60) Provisional application No. 63/015,876, filed on Apr. 27, 2020.

(51) Int. Cl.

| | |
|---|---|
| ***G07C 9/29*** | (2020.01) |
| ***G07C 9/28*** | (2020.01) |
| ***G07C 9/27*** | (2020.01) |

(52) U.S. Cl.

CPC ..... *G07C 9/29* (2020.01); *G07C 9/27* (2020.01); *G07C 9/28* (2020.01)

(58) Field of Classification Search

CPC ..... G07C 9/29; G07C 9/27; G07C 9/28
USPC ..... 340/5.61
See application file for complete search history.

(56) References Cited

U.S. PATENT DOCUMENTS

| | | | | |
|---|---|---|---|---|
| 7,207,480 | B1 * | 4/2007 | Geddes | G06Q 20/32 235/380 |
| 7,636,029 | B1 * | 12/2009 | Zhou | G07C 9/215 340/5.2 |
| 7,724,207 | B2 * | 5/2010 | Mooney | G07C 9/22 345/2.3 |
| 7,936,275 | B2 * | 5/2011 | Bolling | G08B 23/00 340/573.1 |
| 7,982,583 | B1 | 7/2011 | Zhou et al. | |
| 9,697,346 | B2 * | 7/2017 | Jacobs | G06F 21/31 |
| 9,965,603 | B2 * | 5/2018 | Serrato | G06F 21/36 |
| 10,783,546 | B2 * | 9/2020 | Llewelyn | H04W 4/12 |
| 10,818,379 | B2 * | 10/2020 | Krishnan | B01L 3/502715 |
| 10,937,263 | B1 * | 3/2021 | Tout | G07C 9/00174 |
| 2007/0158409 | A1 * | 7/2007 | Haas | G06K 1/121 235/380 |

(Continued)

OTHER PUBLICATIONS

Combined Search and Examination Report for GB2105980.3 dated Dec. 15, 2021, 5 pages.

*Primary Examiner* — Nam V Nguyen
(74) *Attorney, Agent, or Firm* — Kowert, Hood, Munyon, Rankin & Goetzel, P.C.; Gareth M. Sampson

(57) ABSTRACT

Systems and methods for displaying a dynamic badge for accessing a facility are disclosed. The dynamic badge may include a display of one or more objects that change shape over time according to a predetermined pattern. The dynamic badge may visible at a specified distance (such as a social distancing limitation). The dynamic badge may be scanned or recognized by a scanning device at the specified distance to determine facility access for a user of the badge.

17 Claims, 7 Drawing Sheets

(56) References Cited

U.S. PATENT DOCUMENTS

| | | | | |
|---|---|---|---|---|
| 2009/0174633 | A1* | 7/2009 | Kumhyr | G09F 3/0294 345/82 |
| 2010/0005156 | A1* | 1/2010 | Wesby | H04W 12/35 709/219 |
| 2017/0264608 | A1* | 9/2017 | Moore | H04W 12/06 |
| 2019/0205680 | A1* | 7/2019 | Miu | G06K 9/00268 |
| 2019/0259228 | A1 | 8/2019 | Truong et al. | |
| 2021/0134097 | A1* | 5/2021 | Lovelock | G07C 9/27 |

* cited by examiner

MOBILE DEVICE ACCESS BADGES

PRIORITY CLAIM

This patent application claims priority to U.S. Provisional Patent Application No. 63/015,876, filed Apr. 27, 2020, which is incorporated by reference as if fully set forth herein.

BACKGROUND OF THE INVENTION

1. Field of the Invention

Embodiments described herein relate to systems and methods for accessing facilities using a dynamic badge displayed using a responsive/mobile device (e.g., a smartphone device) to safely enter a facility.

2. Description of the Relevant Art

Mobile devices have the ability to display badges or other types of identification that can be scanned to provide access to a secured facility. For example, a mobile device can display a moving badge to provide an employee access to a building facility or a secured room within the facility. The badge needs to be visible from a safe inspection space. Most current mobile device based badges require the mobile device to be placed next to or in close proximity to a scanning device so that the scanning device can get a detailed scan of the displayed badge in order to verify the badge. There may be, however, situations (such as social or physical distancing due to a pandemic) where it is beneficial to have a scanning system that allows mobile device displayed badges to be scanned at a distance from the scanning device. Scanning at a distance may avoid unnecessary contact between the user and the scanning device. Such scanning systems must also maintain sufficient security thresholds to prevent unwanted access to a facility. The badge image includes approaches to protect against fraud.

BRIEF DESCRIPTION OF THE DRAWINGS

Features and advantages of the methods and apparatus of the embodiments described in this disclosure will be more fully appreciated by reference to the following detailed description of presently preferred but nonetheless illustrative embodiments in accordance with the embodiments described in this disclosure when taken in conjunction with the accompanying drawings in which.

DETAILED DESCRIPTION OF THE PREFERRED EMBODIMENTS

Figure 1:
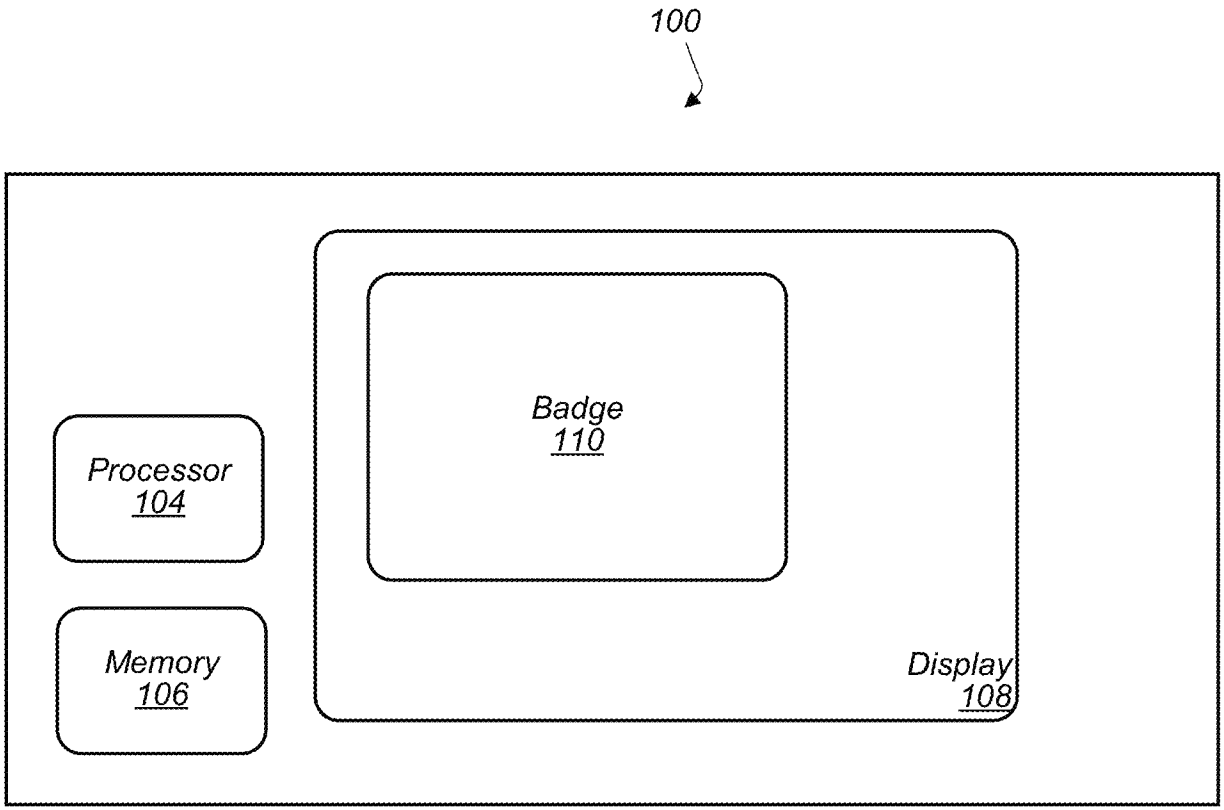
FIG. 1 depicts a representation of an embodiment of a mobile device.

FIG. 1 depicts a representation of an embodiment of a mobile device. In certain embodiments, device 100 includes processor 104, memory 106, and display 108. Device 100 may be a small computing device, which may be, in some cases, small enough to be handheld (and hence also commonly known as a handheld computer or simply a handheld). In certain embodiments, device 100 is any of various types of computer systems devices which are mobile or portable and which perform wireless communications using WLAN communication (e.g., a "mobile device"). Examples of mobile devices include mobile telephones or smart phones, and tablet computers. Various other types of devices may fall into this category if they include wireless or RF communication capabilities (e.g., Wi-Fi, cellular, and/or Bluetooth), such as laptop computers, portable gaming devices, portable Internet devices, and other handheld devices, as well as wearable devices such as smart watches, smart glasses, headphones, pendants, earpieces, etc. In general, the term "mobile device" can be broadly defined to encompass any electronic, computing, and/or telecommunications device (or combination of devices) which is easily transported by a user and capable of wireless communication using, for example, WLAN, Wi-Fi, cellular, and/or Bluetooth. In certain embodiments, device 100 includes any device used by a user with processor 104, memory 106, and display 108. Display 108 may be, for example, an LCD screen or touchscreen. In some embodiments, display 108 includes a user input interface for device 100 (e.g., the display allows interactive input for the user).

Processor 104 may include circuitry configured to execute instructions defined in an instruction set architecture implemented by the processor. Processor 104 may execute the main control software of device 100, such as an operating system. Generally, software executed by processor 104 during use may control the other components of device 100 to realize the desired functionality of the device. The processors may also execute other software (e.g., applications). These applications may provide user functionality, and may rely on the operating system for lower-level device control, scheduling, memory management, etc.

Figure 2:
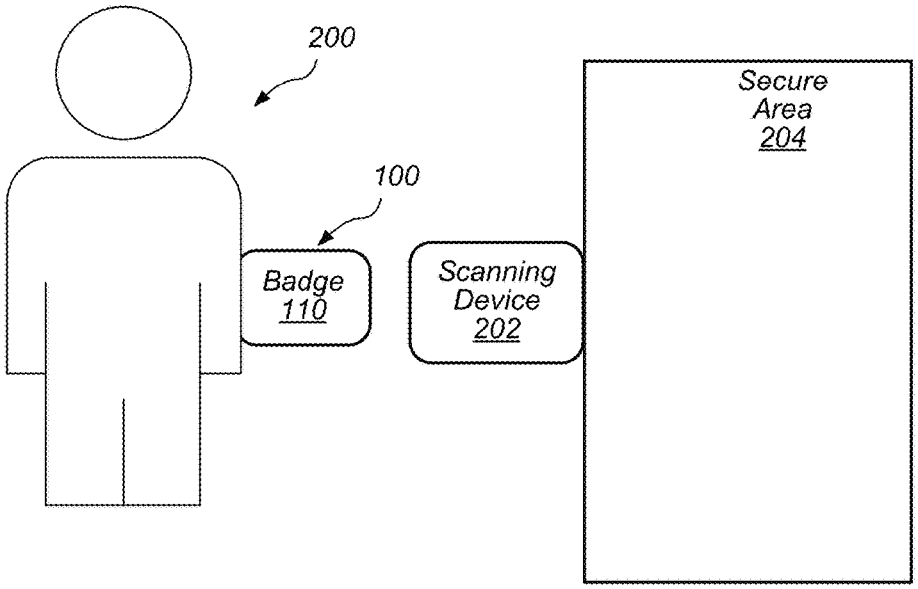
FIG. 2 depicts an example of a user presenting a badge to a scanning device to gain access to a secure area.

In certain embodiments, device 100 displays badge 110 on display 108. Badge 110 may include objects such as markings, emblems, symbols, and combinations thereof. Other identification information may also be presented as part of badge 110. In some embodiments, badge 110 is used to allow a user of device 100 access to a secure area (e.g., a secure facility). FIG. 2 depicts an example of a user presenting badge 110 to a scanning device to gain access to a secure area. In the example, user 200 presents badge 110 on device 100 to scanning device 202 to give the user access to secure area 204 (e.g., by unlocking a door to the secure area). In this example, badge 110 may be used similar to an identification badge on a card (such as a laminated badge card) or a key card to provide access to the secure area.

In the example depicted in FIG. 2, badge 110 includes information that is scanned by scanning device 202 to identify user 200 as an authorized user that is allowed access to secure area 204. In some embodiments, badge 110 is placed in close proximity to scanning device 202 for the scanning device to scan the information on the badge. In certain embodiments, however, it is desirable to allow scanning device 202 to scan badge 110 at a greater distance. For example, there may be situations that require a minimum distance between user 200 and scanning device 202 to be maintained. One example of such a situation may include a pandemic where social or physical distancing is needed to prevent contact with infectious pathogens. Another example may be where a minimum distance is needed for security reasons (e.g., to prevent tampering or to prevent other security measures from being breached).

Figure 3:
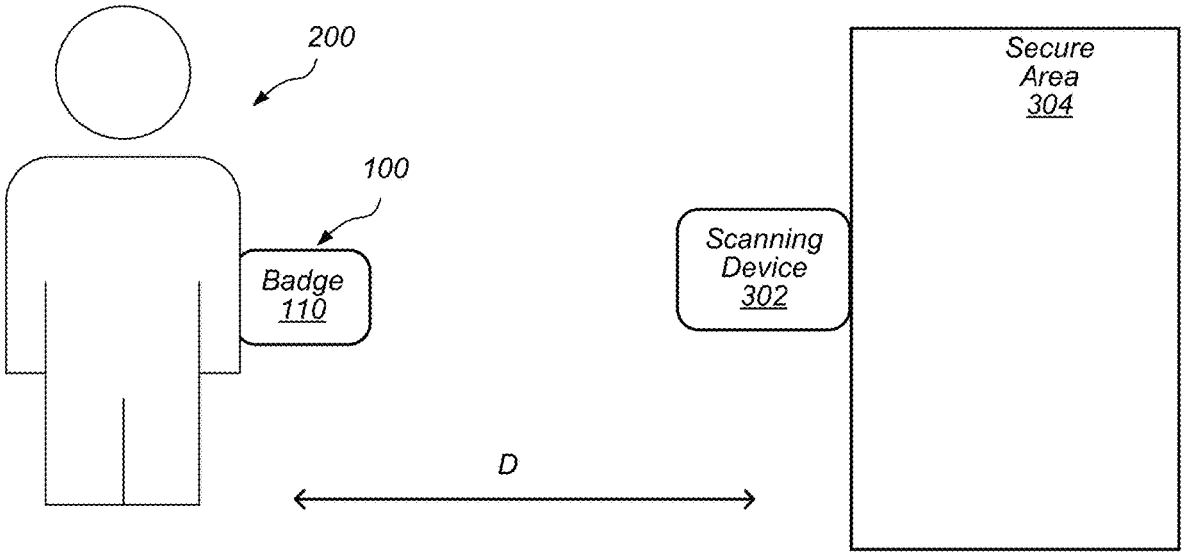
FIG. 3 depicts an example embodiment of a user presenting a badge at distance, D, from a scanning device.

FIG. 3 depicts an example embodiment of user 300 presenting badge 110 at distance, D, from scanning device 302. In some embodiments, distance, D, is at least about 6 feet. Other distances may be contemplated depending on, for example, security needs, distancing needs, and/or scanning ability of scanning device 302. In certain embodiments, scanning device 302 is a machine or electronic scanner. In some embodiments, scanning device 302 may be a person (e.g., a security guard).

The present inventors have recognized that scanned information placed on typical badges that are scanned in close proximity to a scanning device (such as shown in the example of FIG. 2) may not be suitable for the embodiment depicted in FIG. 3 whether the scanning device is a machine or a person. Thus, in certain embodiments, badge 110 includes identification information that is visible (e.g., scannable) to scanning device 302 at distance, D. Using identification information that is visible to scanning device 302 at distance, D, may allow badge 110 to be successfully scanned for authorization by the scanning device in the embodiment depicted in FIG. 3.

Figure 4:
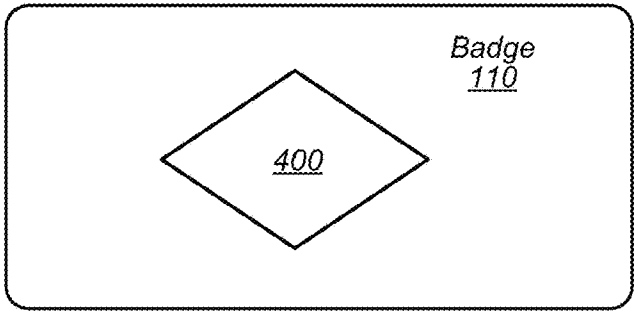
FIG. 4 depicts a representation of an embodiment of a badge with an object.

In certain embodiments, badge 110 includes an object that can be visually scanned by scanning device 302 at distance, D. FIG. 4 depicts a representation of an embodiment of badge 110 with object 400. Object 400 may have a size and shape that is visible to scanning device 302 at distance, D. The present inventors have also recognized that presenting a simple, stationary object may not provide the security threshold necessary for certain secure areas as the object may be easily duplicated.

Figure 5B:
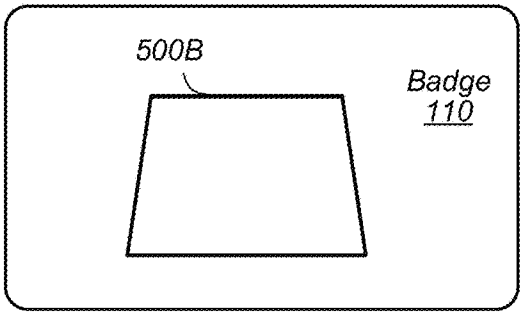
FIGS. 5A-5C depict examples of object shapes that may be presented over different time periods.
Figure 5C:
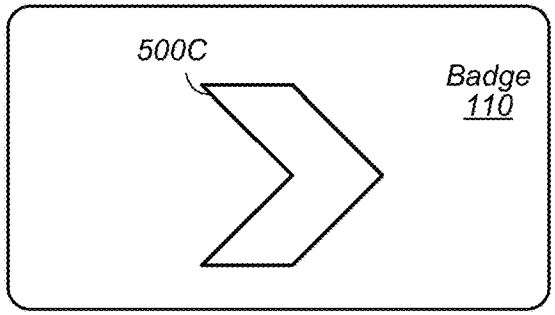
Figure 5A:
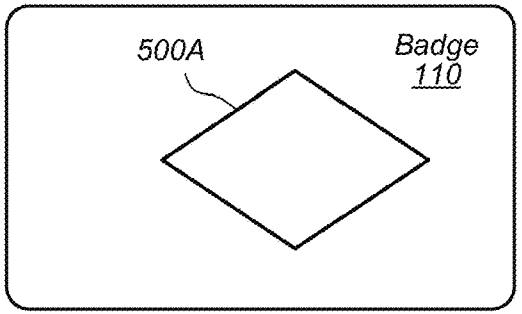

To overcome the security issues with a stationary object, in certain embodiments, object 400 has a shape that changes over time according to a predetermined pattern. The predetermined pattern may include, for example, a number of different shapes presented over a number of different time periods. FIGS. 5A-5C depict examples of object shapes that may be presented over different time periods. In one embodiment, object 400 has first shape 500A (in FIG. 5A) for a first time period, second shape 500B (in FIG. 5B) for a second time period, and third shape 500C (in FIG. 5C) for a third time period. The number of different shapes and number or length of time periods may vary based on, for example, security needs and/or scanning device capabilities. Having the shape of object 400 change over time according to a predetermined pattern may increase the security of using object 400 for authorization by scanning device 302. For example, the changing shape of object 400 over time may inhibit a screenshot from being able to duplicate the object.

In some embodiments, object 400 morphs between the different shapes. For example, object 400 may appear to transform smoothly from one shape to another through animation of the object.

The predetermined pattern for the changes in shape of object 400 over time may be recognizable to scanning device 302. For example, scanning device 302 may be aware of the predetermined pattern and scan object 400 for the predetermined pattern in order to authorize the user for access. In some embodiments, additional information is provided on badge 110. For example, identifying colors or other identifying information that is visible at distance, D, may be added to badge 110 in combination with object 400.

In some embodiments, mobile device 100 displays badge 110 in response to a predetermined set of criteria being met on the device. For example, device 100 may require the user to answer questions about themselves or their status (e.g., health status) before badge 110 is displayed (e.g., the user is "cleared" or authorized before the badge is displayed). As a specific example, in a pandemic situation, the user may be asked questions about their recent travels, physical symptoms, contacts with others, etc. to clear the user before badge 110 is displayed for access. As another example, the user may have to answer one or more security questions before badge 110 is displayed for access.

In certain embodiments, one or more process steps described herein may be performed by one or more processors (e.g., a computer processor) executing instructions stored on a non-transitory computer-readable medium. For example, the process of displaying object 400 with a shape that changes over time according to a predetermined pattern may have one or more steps performed by one or more processors executing instructions stored as program instructions in a computer readable storage medium (e.g., a non-transitory computer readable storage medium).

Figure 6:
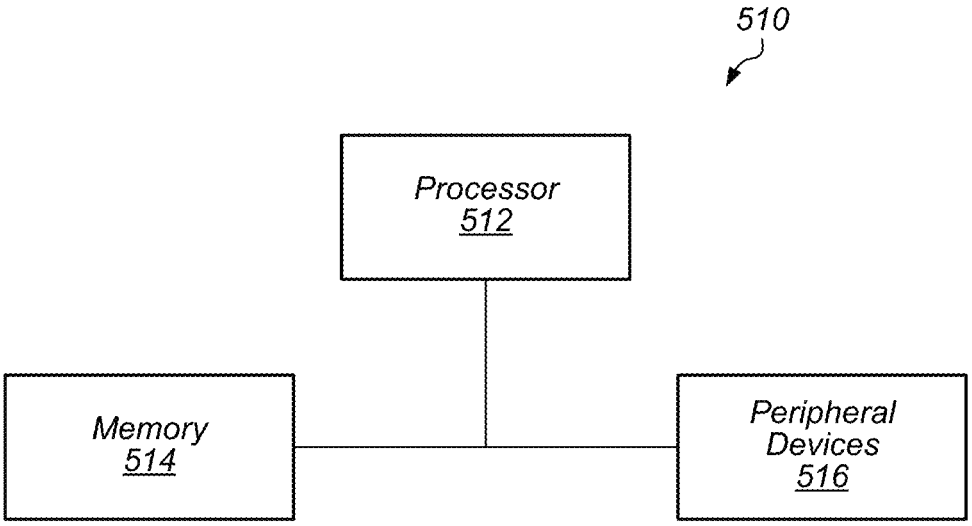
FIG. 6 depicts a block diagram of one embodiment of an exemplary computer system.

FIG. 6 depicts a block diagram of one embodiment of exemplary computer system 510. Exemplary computer system 510 may be used to implement one or more embodiments described herein. In some embodiments, computer system 510 is operable by a user to implement one or more embodiments described herein. In the embodiment of FIG. 6, computer system 510 includes processor 512, memory 514, and various peripheral devices 516. Processor 512 is coupled to memory 514 and peripheral devices 516. Processor 512 is configured to execute instructions which may be in software. In various embodiments, processor 512 may implement any desired instruction set (e.g., Intel Architecture-32 (IA-32, also known as x86), IA-32 with 64 bit extensions, x86-64, PowerPC, Sparc, MIPS, ARM, IA-64, etc.). In some embodiments, computer system 510 may include more than one processor. Moreover, processor 512 may include one or more processors or one or more processor cores.

Processor 512 may be coupled to memory 514 and peripheral devices 516 in any desired fashion. For example, in some embodiments, processor 512 may be coupled to memory 514 and/or peripheral devices 516 via various interconnect. Alternatively, or in addition, one or more bridge chips may be used to coupled processor 512, memory 514, and peripheral devices 516.

Memory 514 may comprise any type of memory system. For example, memory 514 may comprise DRAM, and more particularly double data rate (DDR) SDRAM, RDRAM, etc. A memory controller may be included to interface to memory 514, and/or processor 512 may include a memory controller. Memory 514 may store the instructions to be executed by processor 512 during use, data to be operated upon by the processor during use, etc.

Figure 7:
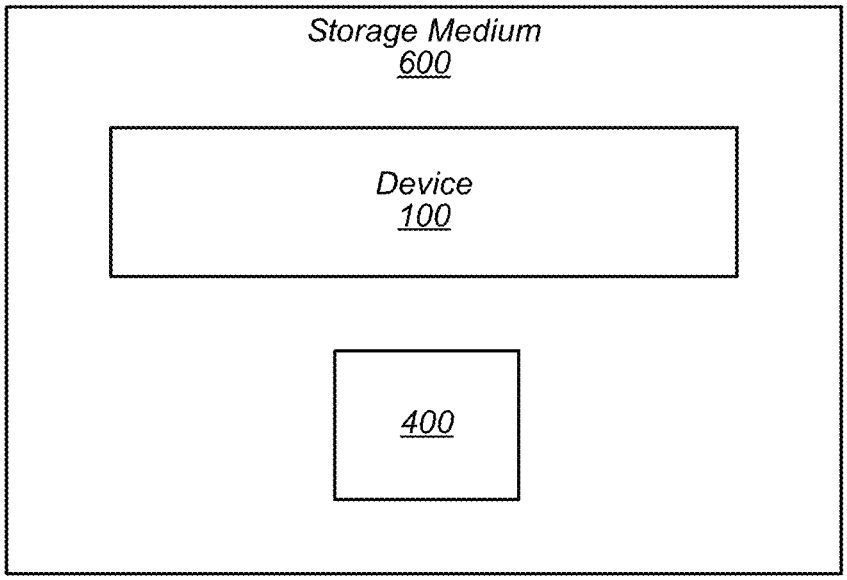
FIG. 7 depicts a block diagram of one embodiment of a computer accessible storage medium.

Peripheral devices 516 may represent any sort of hardware devices that may be included in computer system 510 or coupled thereto (e.g., storage devices, optionally including computer accessible storage medium 600, shown in FIG. 7, other input/output (I/O) devices such as video hardware, audio hardware, user interface devices, networking hardware, etc.).

Turning now to FIG. 7, a block diagram of one embodiment of computer accessible storage medium 600 including one or more data structures representative of device 100 (depicted in FIG. 1) included in an integrated circuit design and one or more code sequences representative of the process of displaying object 400 (shown in FIG. 4) with a shape that changes over time according to a predetermined pattern. Each code sequence may include one or more instructions, which when executed by a processor in a computer, implement the operations described for the corresponding code sequence. Generally speaking, a computer accessible storage medium may include any storage media accessible by a computer during use to provide instructions and/or data to the computer. For example, a computer accessible storage medium may include non-transitory storage media such as magnetic or optical media, e.g., disk (fixed or removable), tape, CD-ROM, DVD-ROM, CD-R, CD-RW, DVD-R, DVD-RW, or Blu-Ray. Storage media may further include volatile or non-volatile memory media such as RAM (e.g. synchronous dynamic RAM (SDRAM), Rambus DRAM (RDRAM), static RAM (SRAM), etc.), ROM, or Flash memory. The storage media may be physically included within the computer to which the storage media provides instructions/data. Alternatively, the storage media may be connected to the computer. For example, the storage media may be connected to the computer over a network or wireless link, such as network attached storage. The storage media may be connected through a peripheral interface such as the Universal Serial Bus (USB). Generally, computer accessible storage medium 600 may store data in a non-transitory manner, where non-transitory in this context may refer to not transmitting the instructions/data on a signal. For example, non-transitory storage may be volatile (and may lose the stored instructions/data in response to a power down) or non-volatile.

In times of a pandemic, or even during the normal flu season, social distancing can help control the spread of a virus. However, when social distancing is not in force, it is important that persons who are sick stay away from employees that are not sick. In a typical work setting there can be hundreds or even thousands of employees in the same worksite (e.g., office building, warehouse, assembly line, etc.). The combination of a large number of employees confined to a building that is an essentially sealed environment can lead to the rapid spread of a respiratory virus if one or more employees come to work when sick. To inhibit sick employees from coming to work, a set of guidelines may be created by the company to determine if an employee can enter a worksite.

In certain embodiments, a mobile device 100, as described previously, displays the status of the employee attempting to enter the building, in addition to acting as an electronic badge identifying the employee. The status, in one embodiment, may be "CLEAR" if the employee is considered to be OK to enter the building, or "NOT CLEAR" if they cannot enter the building. Other words or indications may be used to indicate the status of the employee.

In an embodiment, software can be used to perform a health check assessment on each employee. The software may be included as part of the identification software on the mobile device 100, may be a separate application on the mobile device, or may be on a computer device that can be linked to an account on the mobile device.

In various embodiments, each employee will be required to register for the health check assessment software. To ensure that only current employees are registered, an email may be sent to each employee with a link for the employee to register for the heath check assessment software. During registration, the user will create a unique login identifier and a password. The employee may then be asked to add security options (e.g., security questions/answers) and or an email to allow recovery of the user's login information and/or password. In one embodiment, initial registration is performed on a computer. After the initial registration is completed, the health assessment check may be performed on the computer system or on an application installed on a mobile device.

In an embodiment, each employee will be required to complete a health assessment check before going to the worksite. The health assessment check may include a series of questions used to assess the health of the employee prior to coming to work. The series of questions may cover, at least, the past 24 hours and/or the past 48 hours. In addition to questions, the health assessment check may also require employees to enter vital signs (e.g., body temperature, blood pressure, heart rate, oxygen content of blood, etc.).

Some questions that may be asked by the health care assessment application include, but are not limited to:

1. Work Assignment—What operation site do you plan on reporting to in the next 24 hours?
2. Have you had a FEVER? Please include any temperature of 99.5 degrees or higher, feeling like you had a fever or needed medicine for a fever.
3. Have you had a COUGH?
4. Have you had SHORTNESS OF BREATH?
5. Have you had a SORE THROAT?
6. Have you had a decrease or loss of ability to SMELL or TASTE?
7. Have you had MUSCLE ACHES, CHILLS, FLU-LIKE symptoms, HEADACHE or SEVERE FATIGUE (TIREDNESS)?
8. Have you had NAUSEA, VOMITING, or DIARRHEA?
9. Have you had CLOSE CONTACT (within six feet or less) with a person with confirmed or suspected COVID-19 (or other viral) infection? (including contact at work or home or traveling in the US.)
10. Have you TRAVELED within the last 14 days?

Figure 8:
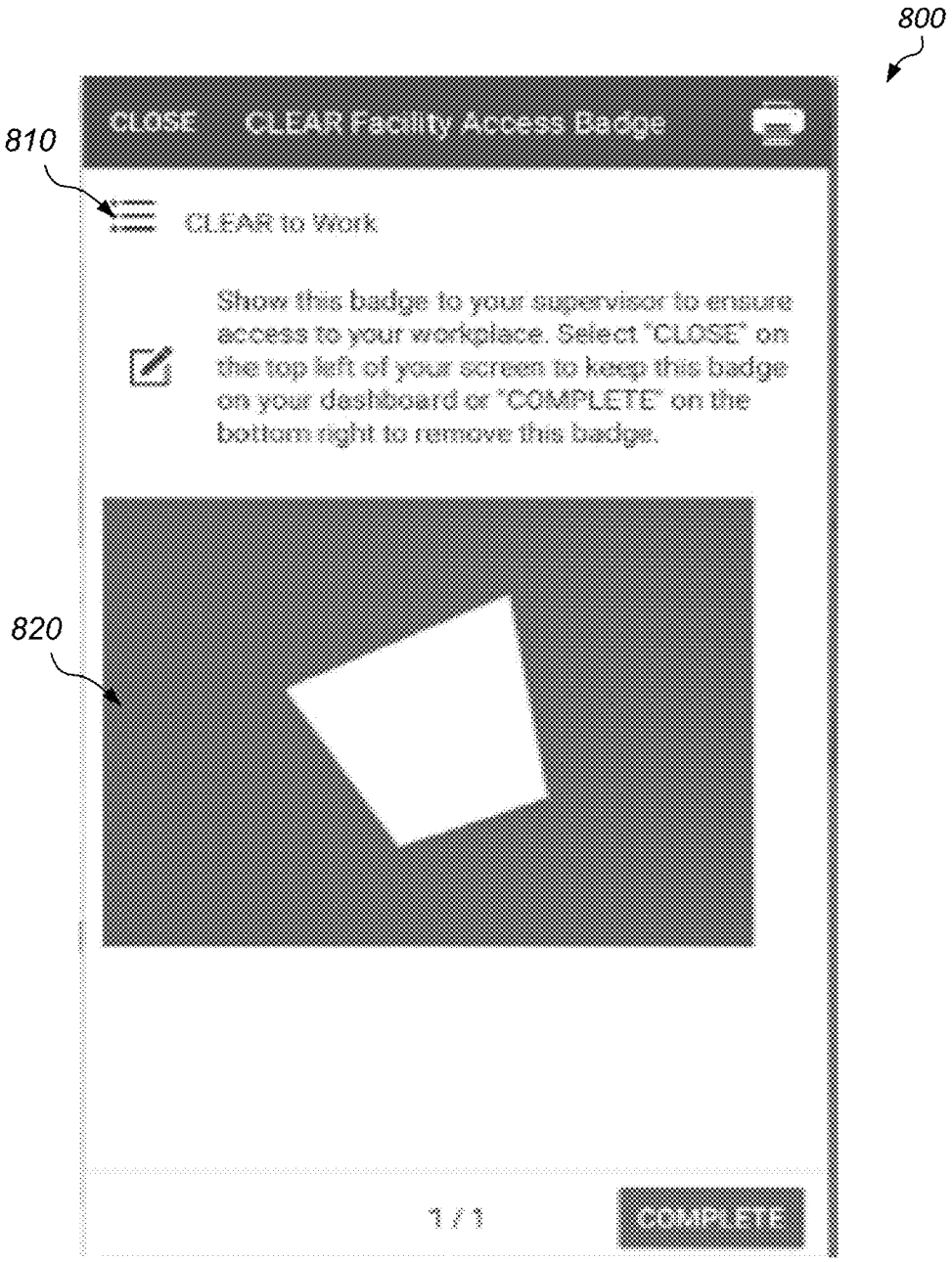
FIG. 8 depicts a representation of a CLEAR employee badge.

Once the questions have been entered, the questions may be compared to a predetermined set of criteria, established by the company, which uses the answers to determine if the employee is clear to come to work, or not clear to come to work. If the employee is clear to come to work, a CLEAR certification, or equivalent, is added to the employee's access badge. FIG. 8 shows an example of an employee's access badge 800 that includes a CLEAR certification. The employee's access badge may be displayed on a mobile device as described above. On the mobile device display, a notification of CLEAR to Work 810 is displayed at the top of the access badge. In the center of the mobile device, the changing symbols for the badge 820 are displayed. In some embodiments, the changing symbols that are used to identify the employee will only be displayed if a clear to work certification has been established for the current day.

Figure 9:
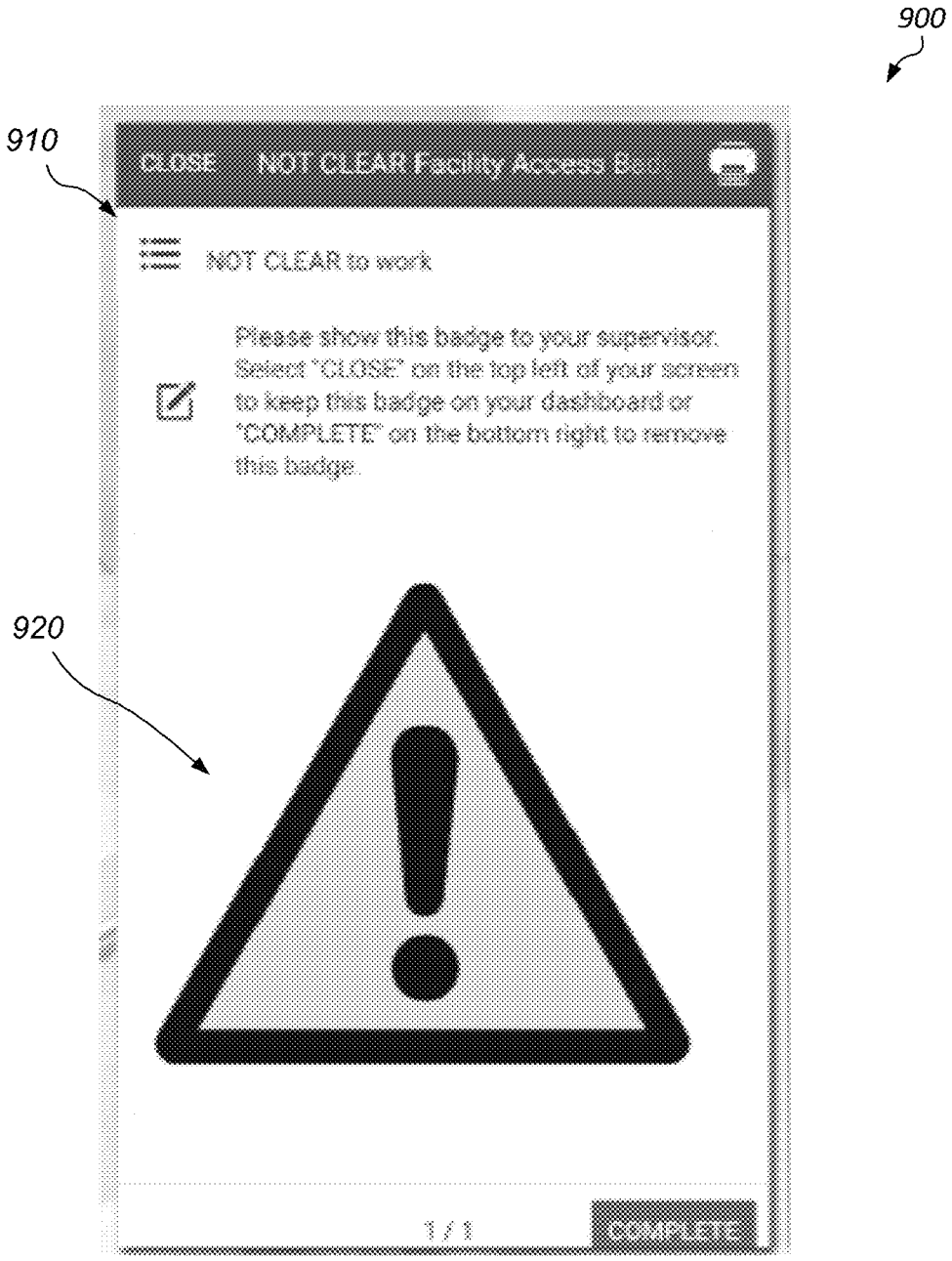
FIG. 9 depicts a representation of a NOT CLEAR employee badge.

If the employee is not clear to come to work, a NOT CLEAR certification, or equivalent, is added to the employee's access badge. FIG. 9 shows an example of an employee's access badge 900 that includes a NOT CLEAR certification. On the mobile device display, a notification of NOT CLEAR to Work 910 is displayed at the top of the access badge. In the center of the mobile device, a static symbol 920 is displayed which indicates that employee is not clear to enter the facility. The static symbol may replace the changing entry badge symbols so that even if the employee comes to work, the employee will be denied entry for lack of proper identification.

The use of a health assessment check will help reduce the number of employees that come to a workplace when sick and/or infectious. For some viral infections, however, an employee may be contagious without exhibiting any of the typical symptoms associated with a viral infection. To reduce the chances of asymptomatic employees spreading the infection, social distancing is implemented to reduce contact between employees. While social distancing may reduce the chance of spreading the viral infection to other employees, there are times when social distancing may be difficult or impossible to implement at the facility. For example, when employees are entering a building to start their work day, or are leaving the building at the end of the work day, there may be a large number of people traversing through a confined area. This may be particularly true when a company requires identification of each employee before access to the building is allowed. During such times it may be difficult, or impossible, to maintain a social distance between employees.

In some embodiments, the problem of having too many people entering or leaving a building at the same time may be alleviated through the use of staggered entry and/or exit times. The use of staggered entry/exit times may be incorporated into the health check assessment software. For example, after an employee has completed their health check assessment the employee may be assigned a time, or time range, during which the employee is allowed to come to work. Since all employees are required to complete the health assessment check before coming to the workplace, each employee can be assigned a time to come to work which will reduce the number of employees entering the building at any given time. A similar process may be used to generate exit times for the employees. In one embodiment, both entry times and exit times are assigned when the employee completes the heath assessment check. In some embodiments, an employee may be able to select the entry time and/or exit time from a list of available times. In various embodiments, the employee exit time may be provided to the employee after the employee has entered the building to ensure that the employee has access to the building for a time sufficient to meet the companies work requirements.

In an embodiment each health assessment check application or program that is associated with the company, or a worksite of the company, may be linked to a centralized company health assessment software. The company health assessment software collects the health check assessments of the employees and can be used to provide analytics regarding the number of CLEAR and NOT CLEAR employees on any given day and/or at any of the company's worksites. This information may be used by the company to determine hot spots within the company. The company may also use this data to determine if the operations should be discontinued due to an increase in number of NOT CLEAR employees. The company health assessment software may also include the criteria used by the health check assessment software to determine if the employee is CLEAR or NOT CLEAR for work. During a health check assessment, the application used by the employee may send the employee's response to the company health assessment software, where the latest criteria is used to evaluate each employee. In alternate embodiments, the criteria are stored on the mobile device or the home computers. When the employee application or software accesses the company health assessment software, any changes or updates to the software, or any changes to the assessment criteria may be downloaded to the device.

Figure 10:
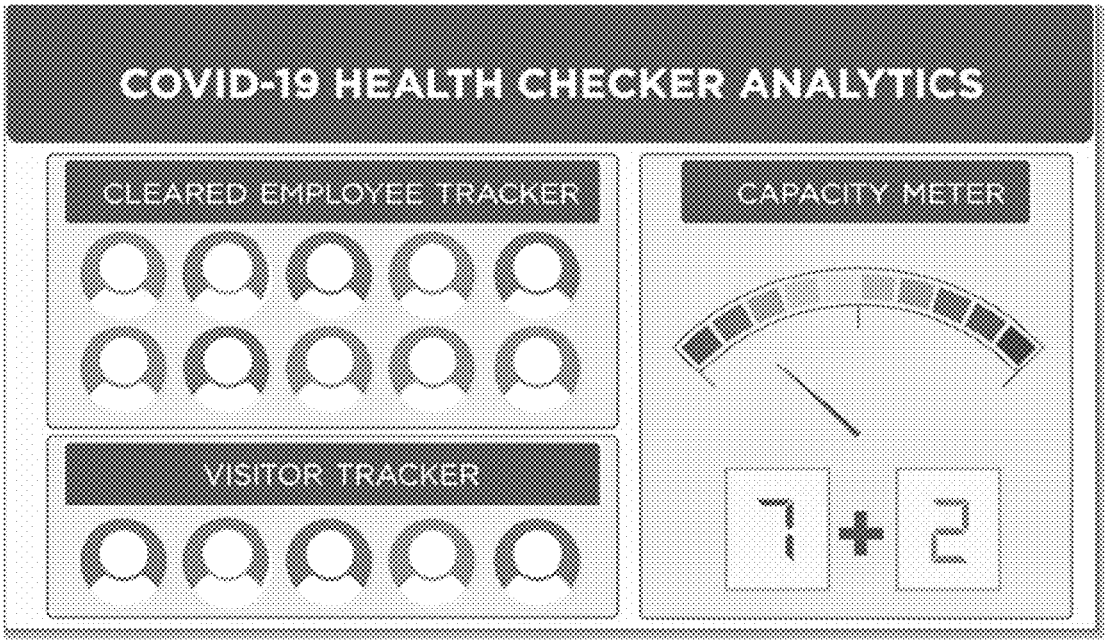
FIG. 10 depicts a representation of a building capacity interface.

When a pandemic situation is ongoing, the number of employees allowed in the building may be less than the actual capacity of the building, in order to allow for safe social distancing between the employees. In one embodiment, a safe worksite capacity may be determined by the company. This number may represent the maximum number of people (employees and visitors) that may be in the building at any given time, while allowing adequate space for social distancing. FIG. 10 shows a worksite capacity interface which may be part of, or coupled to, the company health assessment software. The worksite capacity interface may know the safe worksite capacity which allows the employees to practice social distancing. The worksite capacity interface may also receive information regarding the number of employees that have completed the health assessment checker and the number of employees that have entered the worksite (in this case, a building). In FIG. 10, the number of cleared employees that have not arrived at the building is seven and the number of cleared employees that are in the building is two. The capacity meter shows that the building is in the green region, indicating that more employees can enter the building, even after all the cleared employees arrive at the building. If the building gets close to capacity, the building capacity interface may deny access to the building by employees until the number of employees in the building and the number of CLEAR employees not in the building decreases. The worksite capacity interface may also use mandated entry times and exit times to allow adequate access to the worksite by all employees. For example, if an employee is given a CLEAR health assessment, the employee will be given an entry time, or time range, during which the employee is expected to enter the worksite. The employee may also be given an exit time, or time range, during which the employee is expected to leave the worksite. By coordinating the entry and exit times of all CLEAR employees, the building capacity interface can control the number of employees in the building in such a way as to allow social distancing to be practiced.

While many of the features of the health assessment checker, the company health assessment software, and the worksite capacity interface can control the spread of an infectious disease, employee compliance with the company regulations are necessary to ensure success of the program. The most difficult part of any infectious disease that is spread through the respiratory system is the reducing the amount of person to person contact. Currently, this is minimized by social distancing, which mandates that people remain at least 6 feet (2 meters) from each other at all times. To ensure compliance with social distancing, a company may incorporate radio frequency identification (RFID) hardware into the employee's electronic badge device or some other device that the employee keeps on their person throughout the workday. RFID may be used to track the interaction of employees throughout the building or worksite. For example, RFIDs may be used to determine if employees are less than 6 feet from each other. Repeated violations of the 6-feet rule may lead the company to take corrective action to teach the employee proper social distancing.

The present disclosure includes references to "an "embodiment" or groups of "embodiments" (e.g., "some embodiments" or "various embodiments"). Embodiments are different implementations or instances of the disclosed concepts. References to "an embodiment," "one embodiment," "a particular embodiment," and the like do not necessarily refer to the same embodiment. A large number of possible embodiments are contemplated, including those specifically disclosed, as well as modifications or alternatives that fall within the spirit or scope of the disclosure.

This disclosure may discuss potential advantages that may arise from the disclosed embodiments. Not all implementations of these embodiments will necessarily manifest any or all of the potential advantages. Whether an advantage is realized for a particular implementation depends on many factors, some of which are outside the scope of this disclosure. In fact, there are a number of reasons why an implementation that falls within the scope of the claims might not exhibit some or all of any disclosed advantages. For example, a particular implementation might include other circuitry outside the scope of the disclosure that, in conjunction with one of the disclosed embodiments, negates or diminishes one or more the disclosed advantages. Furthermore, suboptimal design execution of a particular implementation (e.g., implementation techniques or tools) could also negate or diminish disclosed advantages. Even assuming a skilled implementation, realization of advantages may still depend upon other factors such as the environmental circumstances in which the implementation is deployed. For example, inputs supplied to a particular implementation may prevent one or more problems addressed in this disclosure from arising on a particular occasion, with the result that the benefit of its solution may not be realized. Given the existence of possible factors external to this disclosure, it is expressly intended that any potential advantages described herein are not to be construed as claim limitations that must be met to demonstrate infringement. Rather, identification of such potential advantages is intended to illustrate the type(s) of improvement available to designers having the benefit of this disclosure. That such advantages are described permissively (e.g., stating that a particular advantage "may arise") is not intended to convey doubt about whether such advantages can in fact be realized, but rather to recognize the technical reality that realization of such advantages often depends on additional factors.

Unless stated otherwise, embodiments are non-limiting. That is, the disclosed embodiments are not intended to limit the scope of claims that are drafted based on this disclosure, even where only a single example is described with respect to a particular feature. The disclosed embodiments are intended to be illustrative rather than restrictive, absent any statements in the disclosure to the contrary. The application is thus intended to permit claims covering disclosed embodiments, as well as such alternatives, modifications, and equivalents that would be apparent to a person skilled in the art having the benefit of this disclosure.

For example, features in this application may be combined in any suitable manner. Accordingly, new claims may be formulated during prosecution of this application (or an application claiming priority thereto) to any such combination of features. In particular, with reference to the appended claims, features from dependent claims may be combined with those of other dependent claims where appropriate, including claims that depend from other independent claims. Similarly, features from respective independent claims may be combined where appropriate.

Accordingly, while the appended dependent claims may be drafted such that each depends on a single other claim, additional dependencies are also contemplated. Any combinations of features in the dependent that are consistent with this disclosure are contemplated and may be claimed in this or another application. In short, combinations are not limited to those specifically enumerated in the appended claims.

Where appropriate, it is also contemplated that claims drafted in one format or statutory type (e.g., apparatus) are intended to support corresponding claims of another format or statutory type (e.g., method).

Because this disclosure is a legal document, various terms and phrases may be subject to administrative and judicial interpretation. Public notice is hereby given that the following paragraphs, as well as definitions provided throughout the disclosure, are to be used in determining how to interpret claims that are drafted based on this disclosure.

References to a singular form of an item (i.e., a noun or noun phrase preceded by "a," "an," or "the") are, unless context clearly dictates otherwise, intended to mean "one or more." Reference to "an item" in a claim thus does not, without accompanying context, preclude additional instances of the item. A "plurality" of items refers to a set of two or more of the items.

The word "may" is used herein in a permissive sense (i.e., having the potential to, being able to) and not in a mandatory sense (i.e., must).

The terms "comprising" and "including," and forms thereof, are open-ended and mean "including, but not limited to."

When the term "or" is used in this disclosure with respect to a list of options, it will generally be understood to be used in the inclusive sense unless the context provides otherwise. Thus, a recitation of "x or y" is equivalent to "x or y, or both," and thus covers 1) x but not y, 2) y but not x, and 3) both x and y. On the other hand, a phrase such as "either x or y, but not both" makes clear that "or" is being used in the exclusive sense.

A recitation of "w, x, y, or z, or any combination thereof" or "at least one of . . . w, x, y, and z" is intended to cover all possibilities involving a single element up to the total number of elements in the set. For example, given the set [w, x, y, z], these phrasings cover any single element of the set (e.g., w but not x, y, or z), any two elements (e.g., w and x, but not y or z), any three elements (e.g., w, x, and y, but not z), and all four elements. The phrase "at least one of w, x, y, and z" thus refers to at least one element of the set [w, x, y, z], thereby covering all possible combinations in this list of elements. This phrase is not to be interpreted to require that there is at least one instance of w, at least one instance of x, at least one instance of y, and at least one instance of z.

Various "labels" may precede nouns or noun phrases in this disclosure. Unless context provides otherwise, different labels used for a feature (e.g., "first conduit," "second conduit," "particular conduit," "given conduit," etc.) refer to different instances of the feature. Additionally, the labels "first," "second," and "third" when applied to a feature do not imply any type of ordering (e.g., spatial, temporal, logical, etc.), unless stated otherwise.

The phrase "based on" or is used to describe one or more factors that affect a determination. This term does not foreclose the possibility that additional factors may affect the determination. That is, a determination may be solely based on specified factors or based on the specified factors as well as other, unspecified factors. Consider the phrase "determine A based on B." This phrase specifies that B is a factor that is used to determine A or that affects the determination of A. This phrase does not foreclose that the determination of A may also be based on some other factor, such as C. This phrase is also intended to cover an embodiment in which A is determined based solely on B. As used herein, the phrase "based on" is synonymous with the phrase "based at least in part on."

Within this disclosure, different entities (which may variously be referred to as "units," "circuits," other components, etc.) may be described or claimed as "configured" to perform one or more tasks or operations. This formulation—[entity] configured to [perform one or more tasks]—is used herein to refer to structure (i.e., something physical). More specifically, this formulation is used to indicate that this structure is arranged to perform the one or more tasks during operation. A structure can be said to be "configured to" perform some task even if the structure is not currently being operated. Thus, an entity described or recited as being "configured to" perform some task refers to something physical, such as a device, circuit, a system having a processor unit and a memory storing program instructions executable to implement the task, etc. This phrase is not used herein to refer to something intangible.

In some cases, various units/circuits/components may be described herein as performing a set of task or operations. It is understood that those entities are "configured to" perform those tasks/operations, even if not specifically noted.

The term "configured to" is not intended to mean "configurable to." An unprogrammed FPGA, for example, would not be considered to be "configured to" perform a particular function. This unprogrammed FPGA may be "configurable to" perform that function, however. After appropriate programming, the FPGA may then be said to be "configured to" perform the particular function.

For purposes of United States patent applications based on this disclosure, reciting in a claim that a structure is "configured to" perform one or more tasks is expressly intended not to invoke 35 U.S.C. § 112(f) for that claim element. Should Applicant wish to invoke Section 112(f) during prosecution of a United States patent application based on this disclosure, it will recite claim elements using the "means for" [performing a function] construct.

What is claimed is:

1. A mobile device, comprising:

a display screen;

a wireless transceiver;

a processor circuit that includes one or more processing cores; and memory storing program instructions executable by the processor circuit to:

display, on the display screen of the mobile device, a badge configured to be viewed and authorized by a scanning device to permit access to a facility for a user of the mobile device, wherein the badge includes at least one object that changes geometric shape over time according to a predetermined pattern, wherein the at least one object morphs from a first geometric shape into a second geometric shape during at least a portion of the predetermined pattern, the first geometric shape being different than the second geometric shape, and wherein the predetermined pattern is recognizable by the scanning device to authorize the badge.

2. The mobile device of claim 1, wherein the at least one object is viewable by the scanning device at a distance of at least about 6 feet.

3. The mobile device of claim 1, further comprising a radio frequency identification device configured to allow a location of the user to be determined by the mobile device.

4. The mobile device of claim 1, wherein the at least one object morphs from the first geometric shape to the second geometric shape using animation pattern.

5. The mobile device of claim 1, wherein the at least one object changes from the first geometric shape to the second geometric shape after a predetermined period of time in the predetermined pattern.

6. The mobile device of claim 1, wherein the at least one object further includes one or more of the following: markings, emblems, symbols, and combinations thereof.

7. The mobile device of claim 1, wherein the predetermined pattern includes a predetermined number of geometric shapes displayed over predetermined time periods.

8. The mobile device of claim 1, wherein the predetermined pattern includes the first geometric shape displayed over a first predetermined time period and the second geometric shape displayed over a second predetermined time period, wherein the second predetermined time period begins after the first predetermined time period.

9. The mobile device of claim 1, wherein the program instructions include instructions to display the badge in response to a predetermined set of criteria being met by the user.

10. The mobile device of claim 9, wherein the predetermined set of criteria includes a health status of the user.

11. The mobile device of claim 10, wherein the program instructions include instructions to display a certification of the health status of the user in addition to the badge.

12. A method of displaying a badge on a mobile device, comprising:

displaying, on a display screen of the mobile device by a computer system on the mobile device, a badge that includes at least one object having a geometric shape; and changing the geometric shape of the at least one object over time according to a predetermined pattern, wherein the at least one object morphs from a first geometric shape into a second geometric shape during at least a portion of the predetermined pattern, the first geometric shape being different than the second geometric shape, and wherein the predetermined pattern is recognizable by a scanning device to authorize the badge.

13. The method of claim 12, further comprising displaying the at least one object such that the at least one object is viewable by the scanning device at a distance of at least about 6 feet.

14. The method of claim 12, wherein the predetermined pattern includes the at least one object morphing between geometric shapes over time.

15. The method of claim 12, wherein the predetermined pattern includes the at least one object changing colors over time.

16. The method of claim 12, wherein the predetermined pattern includes the at least one object animating from the first geometric shape to the second geometric shape after a predetermined period of time.

17. The method of claim 12, further comprising assessing a predetermined set of criteria for a user, and displaying the badge in response to the predetermined set of criteria being met by the user.

* * * * *